United States Patent [19]

Steel

[11] Patent Number: 4,723,658

[45] Date of Patent: Feb. 9, 1988

[54] RECLOSABLE CARTON

[75] Inventor: Thomas C. Steel, Malverne, N.Y.

[73] Assignee: H. B. Fuller Company, St. Paul, Minn.

[21] Appl. No.: 887,785

[22] Filed: Jul. 21, 1986

[51] Int. Cl.[4] ..... B65D 5/54

[52] U.S. Cl. ..... 206/616; 206/608; 206/611; 206/626

[58] Field of Search ..... 206/608, 609, 611, 615, 206/616, 617, 618, 622, 626, 631, 633; 215/257; 220/279

[56] References Cited

U.S. PATENT DOCUMENTS

| | | | |
|---|---|---|---|
| 1,604,063 | 10/1926 | Miller | 215/257 |
| 2,925,188 | 2/1960 | Grumbles | 215/257 |
| 2,981,455 | 4/1961 | Cope | 206/611 |
| 3,263,899 | 8/1966 | Collura et al. | 206/626 |
| 3,387,739 | 6/1968 | Rohowetz | 220/279 |
| 3,494,538 | 2/1970 | Matthews | 206/616 |
| 3,599,859 | 8/1971 | Maierson | 206/616 |
| 3,617,311 | 11/1971 | Beltle | 206/616 |
| 4,328,924 | 5/1982 | Neff et al. | 206/616 |
| 4,567,987 | 2/1986 | Lepisto et al. | 206/618 |
| 4,621,736 | 11/1986 | Roccaforte | 206/616 |

FOREIGN PATENT DOCUMENTS

| | | | |
|---|---|---|---|
| 999567 | 11/1976 | Canada | 206/626 |

*Primary Examiner*—Stephen Marcus
*Assistant Examiner*—Gary E. Elkins
*Attorney, Agent, or Firm*—Collard, Roe & Galgano

[57] ABSTRACT

There is provided a carton and a blank therefor having top end flaps connected to the front, rear and side panels of the carton blank wherein a first top end flap connected to either the front or back panel of the carton blank is adapted to overlap a second top end flap disposed opposite to the first top end flap and which is connected to the remaining front or back panel of the carton blank. The first or overlapping top end flap is tightly adhesively connected to the second or underlying top end along the length of the outer edge of the first flap and the opening feature for the carton top is provided by a tear strip in the overlapping first end flap between the adhesion area thereof and the score or fold line connecting the flap to the connecting front or rear panel, as the case may be. The tear strip consists of a removable strip extending the length of the flap which cleanly and completely separates therefrom so that the first flap can be separated from the second flap. The tear strip includes a tape like element formed of a hot melt string which is adhered along the inside of the flap along the desired path of the tear strip and defines the tear strip when the tape like element is torn through the sheet material of the flap.

15 Claims, 5 Drawing Figures

RECLOSABLE CARTON

The present invention relates to cartons and, more particularly, it relates to cartons of the reclosable type having an improved opening means and the carton blanks from which such cartons are formed.

Reclosable cartons of the type used as containers for products such as dry cereals, frozen foods, dog and cat foods, detergent products, cake mixes, etc. are generally formed from carton blanks made from sheet material such as paper board. Such cartons are often provided with a top end wall formed from several folded over carton blank flaps which are hingedly connected to the respective front, rear and side panels of the carton and which are connected together by means of adhesive to sealingly close the top of the carton so as to protect the product therewithin subsequent to product filling so that the carton can be shipped and stored without loss or damage to the packaged product. Suitable opening features are generally provided for the tops of such cartons so as to facilitate opening of the cartons by consumers without necessitating the destruction of the top end walls of the cartons. Such opening features can range from spot gluing the various top flaps of the carton blank together to fully gluing the top flaps together and providing a die cut tear strip or zipper across the length of the carton top. Whatever opening feature may be utilized, there is also generally provided a reclosure means so that the carton can be reclosed subsequent to its initial opening so as to permit intermittent use of the product packaged therein. A reclosure means which is frequently used consists of male and female tab engaging elements formed on the opposing top end flaps connected to the front and rear panels of the carton, commonly known as the "cereal lock".

As indicated above, one type of opening feature which is frequently utilized involves a die cut tear strip or zipper provided in the top end wall of the carton. Such a means permits full gluing or a tight adhesive interconnection of the top flaps connected to the front and back carton panels, the tear strip being provided in the overlapping flap between the adhesive area and the flap connection to its respective front or back panel. In this manner the two top flaps can be disconnected from one another and a "cereal lock" appropriately included with the flaps for proper reclosure. However, a drawback to the use of a die cut tear strip or zipper for the opening means of such cartons is that such devices frequently function inadequately resulting in the top end wall of the carton being torn or otherwise damaged during opening and rendering the reclosure of the carton top difficult if not impossible.

In the case where the top end flaps of the carton are merely spot glued so as to facilitate opening, the required adhesive applying operation is relatively expensive because of low machine speed and high spoilage rate and, furthermore, such a system affords less protection against tampering than flaps that have full adhesive strips and which are tightly adhered to one another to form a tight adhesive connection. If one wishes to tamper with a carton top which has only been spot glued, it is only necessary to separate the flaps which, because of the spot gluing, would not result in damage thereto and then subsequently re-glue the flaps. Tampering would thus not be evident. With flaps which have been fully glued, tampering would be evident since damage to the flaps would invariably result when they were separated.

It is, therefore, a primary object of the present invention to provide a carton having a folded top wall construction incorporating an opening feature which permits a tight adhesive connection of the flaps thereof and which insures the opening of the carton top without causing damage to the carton top end flaps or to the elements of the carton top reclosure means so that the carton may thereafter be reclosed without difficulty.

The above object, as well as others which will hereinafter become apparent, is accomplished in accordance with the present invention by the provision of a carton and a blank therefor having top end flaps connected to the front, rear and side panels of the carton blank wherein a first top end flap connected to either the front or back panel of the carton blank is adapted to overlap a second top end flap disposed opposite to the first top end flap and which is connected to the remaining front or back panel of the carton blank. The first or overlapping top end flap is tightly adhesively connected to the second or underlying top end flap along the length of the outer edge of the first flap and the opening feature for the carton top is provided by a tear strip in the overlapping first end flap between the adhesion area thereof and the score or fold line connecting the flap to the connecting front or rear panel, as the case may be. The tear strip consists of a removable strip extending the length of the flap which cleanly and completely separates therefrom so that the first flap can be separated from the second flap. The tear strip includes a tape like element which is adhered along the inside of the flap along the desired path of the tear strip and defines the tear strip when the tape like element is torn through the sheet material of the flap. The use of the tape like element ensures a complete rupture of the flap along the tear strip. Cut scores may also be provided on the outside of the flap along the boundary of the tear strip in order to delimit the path of the tear strip. A reclosure feature is also provided for the opened carton top which may be in the form of a male tab element in one of the first or second end wall flaps and a female tab element in the opposite end wall flap.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
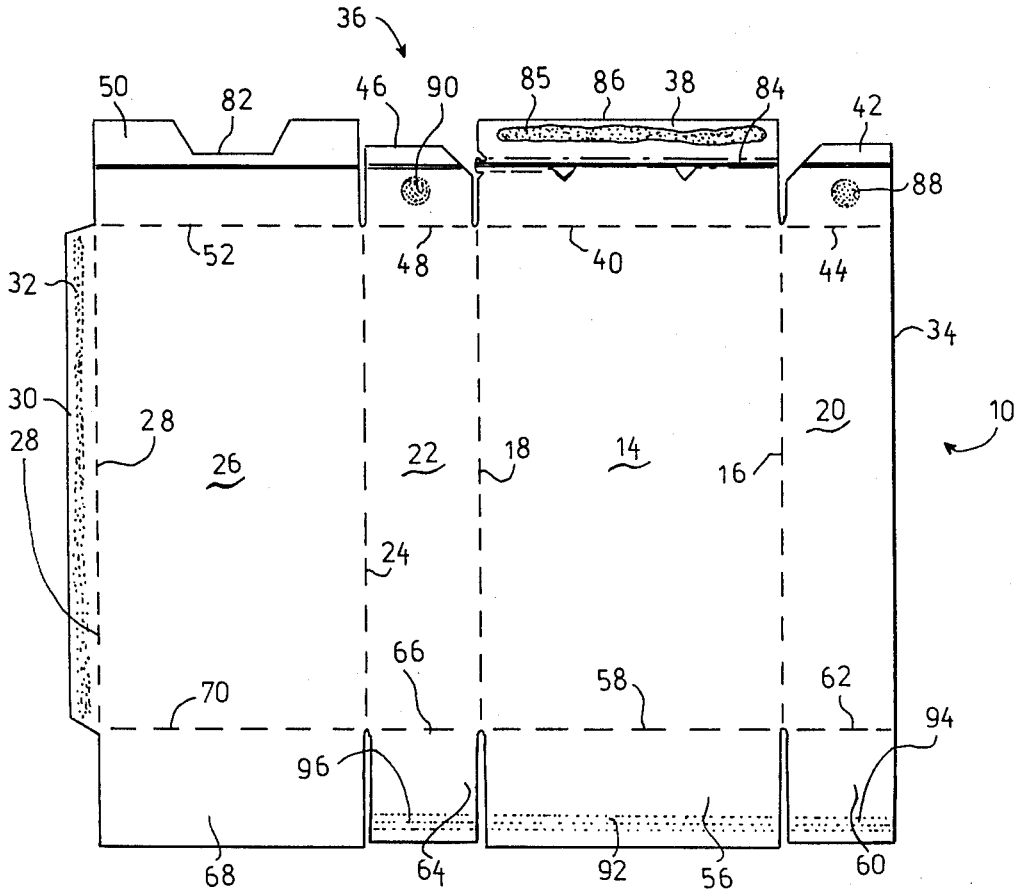
FIG. 1 is a plan view of the inside of a carton blank according to the present invention.
Figure 2:
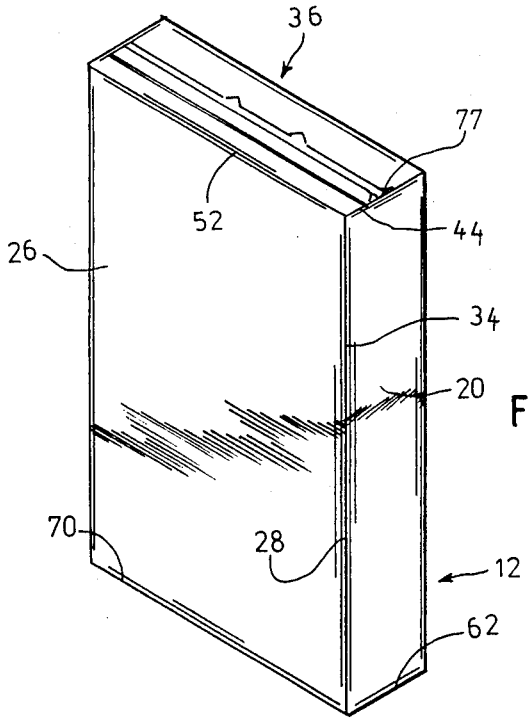
FIG. 2 is a perspective view showing the blank of FIG. 1 completely folded up to form a carton.

Now turning to the drawings, there is shown in FIG. 1, a single piece carton blank, designated 10, which is adapted to be erected into the finished carton 12 shown in FIG. 2 and which may be formed of sheet material such as paperboard. Carton blank 10 includes a major panel 14, which, for the sake of convenience, will hereinafter be referred to as the front panel of carton 12, which is connected respectively at score or fold lines 16 and 18 to right and left side panels 20 and 22. Left side panel 22 in turn is connected along score line 24 to a major or back panel 26 which in turn is connected along score line 28 to an adhesive side flap or glue seam 30. Side flap 30 is provided with a continuous adhesive strip 32 (shown in phantom) extending along its length on the outside of carton blank 10. In the erection of carton 12, side flap 30 is firmly adhered to the inside of right side panel 20 along outer edge 34 thereof by means of adhesive strip 32.

A top end wall, designated 36, of carton 12 includes a front panel top end flap 38 connected at a score line 40 to front panel 14, a right side panel top end flap 42 connected at a score line 44 to right side panel 20, a left side panel top end flap 46 connected at a score line 48 to left side panel 22, and a back panel top end flap 50 connected at a score line 52 to back panel 26. The depths of flaps 38 and 50 are such that they overlap one another when carton 12 is erected, as clearly seen in FIG. 2. The opposite or bottom end wall, designated 54, includes a front panel bottom end flap 56 connected at a score line 58 to front panel 14, a right side panel bottom end flap 60 connected at a score line 62 to right side panel 20, a left side panel bottom end flap 64 connected at a score line 66 to left side panel 22, and a back panel bottom end flap 68 connected at a score line 70 to back panel 26.

Figure 3:
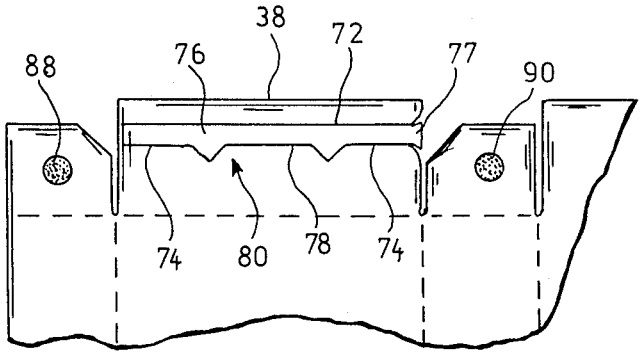
FIG. 3 is a fragmentary plan view of the outside of the carton blank of FIG. 1.

As clearly seen in FIG. 3, the outside of front panel top end flap 38 is provided with an outer lengthwise cut score 72 and an inner cut score 74 parallel to score 72 which define a tear strip 76 having a pull tab 77. As clearly seen, the central segment of cut score 74 is a knife cut 78 which defines a male tab element 80. Back panel top end flap 50 is provided with a complementary female tab element 82 which is adapted to cooperate with male tab element 80. In order to ensure the rupture of the paperboard or sheet material and the removal of tear strip 76, a tear strip tape, designated 84, is adhered to the inside of carton blank 10 between cut score lines 72 and 74. The effect of this tear strip tape 84 is to cause the rupture of the material and define the limits of tear for tear strip 76 so that uneven tearing of flap 38 or damage thereto does not result. Although cut score lines 72 and 74 define the limits of tear strip 76, such cut scores are unnecessary to the proper functioning of tear strip tape 84 which is the operative element in the removal of tear strip 76 and which causes the tearing of the paperboard or other sheet material. The function of cut scores 72 and 74 is to ensure that the resulting fracture line upon removal of tear strip 76 is straight and clean.

In the manufacture of carton blank 10, tear strip tape 84 is applied continuously to the sheet material prior to the die cutting thereof and may be in the form of a pressure sensitive tape, a hot melt coated string or tape or a liquid adhesive coated string or tape. Preferably, tear strip tape 84 is formed from a hot melt pre-coated string or tape which is heat activated and applied under pressure so as to flatten the hot melt coated string or tape into the form of a narrow tape. It is also possible to utilize an uncoated string to which a hot melt in liquid form is applied just prior to application to carton blank 10. In this case, the coated string need not again be heated to melt the hot melt but is merely applied with pressure. The hot melt coated string and the hot melted coated tape may be formed of any type of twisted or untwisted yarn and preferably are formed of untwisted polyester yarn having a high melting point and a hot melt which may be formed of ethylene vinyl acetate combinations. Such hot melt coated strings and tapes are readily available commercially. An advantage in the use of hot melt coated string and tape over the pressure sensitive tapes is that during application, the trailing end of a spool of hot melt coated string or tape may be tied onto the leading end of the next spool so that the operation can continue without interruption. In the case of pressure sensitive tapes, it is often necessary to halt the operation or slow it down in order to change spools and, since the tape is applied during the printing operation, a great deal of wasted sheet material results. Also, since pressure sensitive tapes have adhesive on only the one side thereof, there exists the possibility that the tape could turn during application resulting in product spoilage. Furthermore, pressure sensitive tapes are generally more expensive than hot melt strings or tapes.

Various methods, adhesives, types of equipment and sequence of steps in erecting cartons and filling them with product are well known to those skilled in the art. In the description which follows, the sequence of steps in erecting carton blank 10 into carton 12 is given for purposes of illustration and example.

In setting up or erecting carton 12 from carton blank 10, a continuous adhesive strip 85 is applied to the inside of front panel top end flap 38 at or near the outside edge 86 thereof so that tear strip 76 is between fold line 40, connecting front panel top end flap 38 to front panel 14, and adhesive strip 85. Also, as clearly seen in FIGS. 1 and 3, adhesive spots (shown in phantom), designated 88 and 90, are applied to the outside surfaces of right and left side panel flaps 42 and 46, respectively. A continuous adhesive strip (shown in phantom) is also applied on the outside surfaces of bottom flaps 56, 60 and 64, the segments of which are designated 92, 94 and 96, respectively. Thus, in erecting carton 12, panels 14, 20, 22, 26 and flap 30 are folded ninety degrees along score lines 16, 18, 24 and 28 and adhesive strip 32 firmly adheres the inside of right side panel 20 at edge 34 to side flap 30 to form a substantially rectangular carton having open ends. Bottom end wall 54 is constructed by folding right and left side panel bottom end flaps 60 and 64 ninety degrees at fold lines 62 and 66 and then subsequently folding front panel bottom end flap 56 ninety degrees at fold line 58 onto flaps 60 and 64 with pressure so as to form an adhesive connection between flap 56 and flaps 60 and 64. Subsequently, back panel bottom end flap 68 is folded ninety degrees at fold line 70 and pressed into engagement with front panel bottom end flap 56 so as to form a tight adhesive connection therewith by means of adhesive strip segment 92. Next, after semi-erected carton 12 has been filled with product, top end wall 36 is formed by folding right and left side panel top end flaps 42 and 46 ninety degrees at their respective fold lines 44 and 48 and folding back panel top end flap 50 ninety degrees at fold line 52 and pressing the same together so as to form an adhesive connection therebetween. Thereafter, front panel top end flap 38 is folded ninety degrees at fold line 40 to overlap back panel top end flap 50 and flap 38 is pressed into engagement with the outside surface of flap 50 to form a tight adhesive connection therewith by means of adhesive strip 85.

Figure 4:
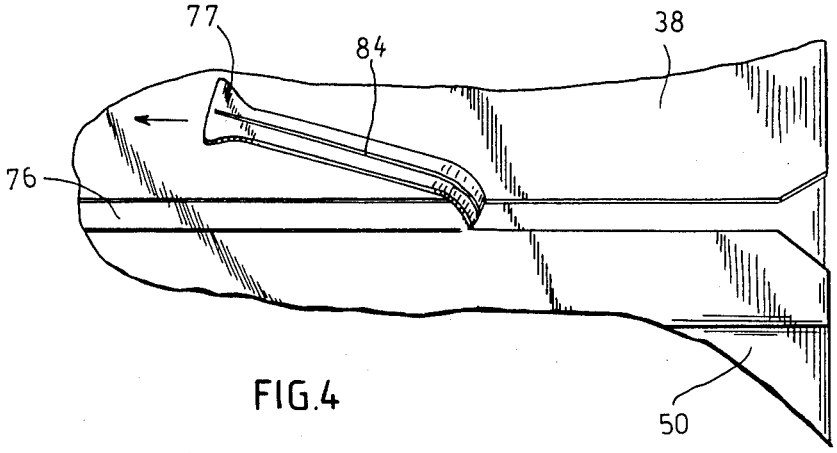
FIG. 4 is a fragmentary detail view of the opening feature of the carton of FIG. 2.
Figure 5:
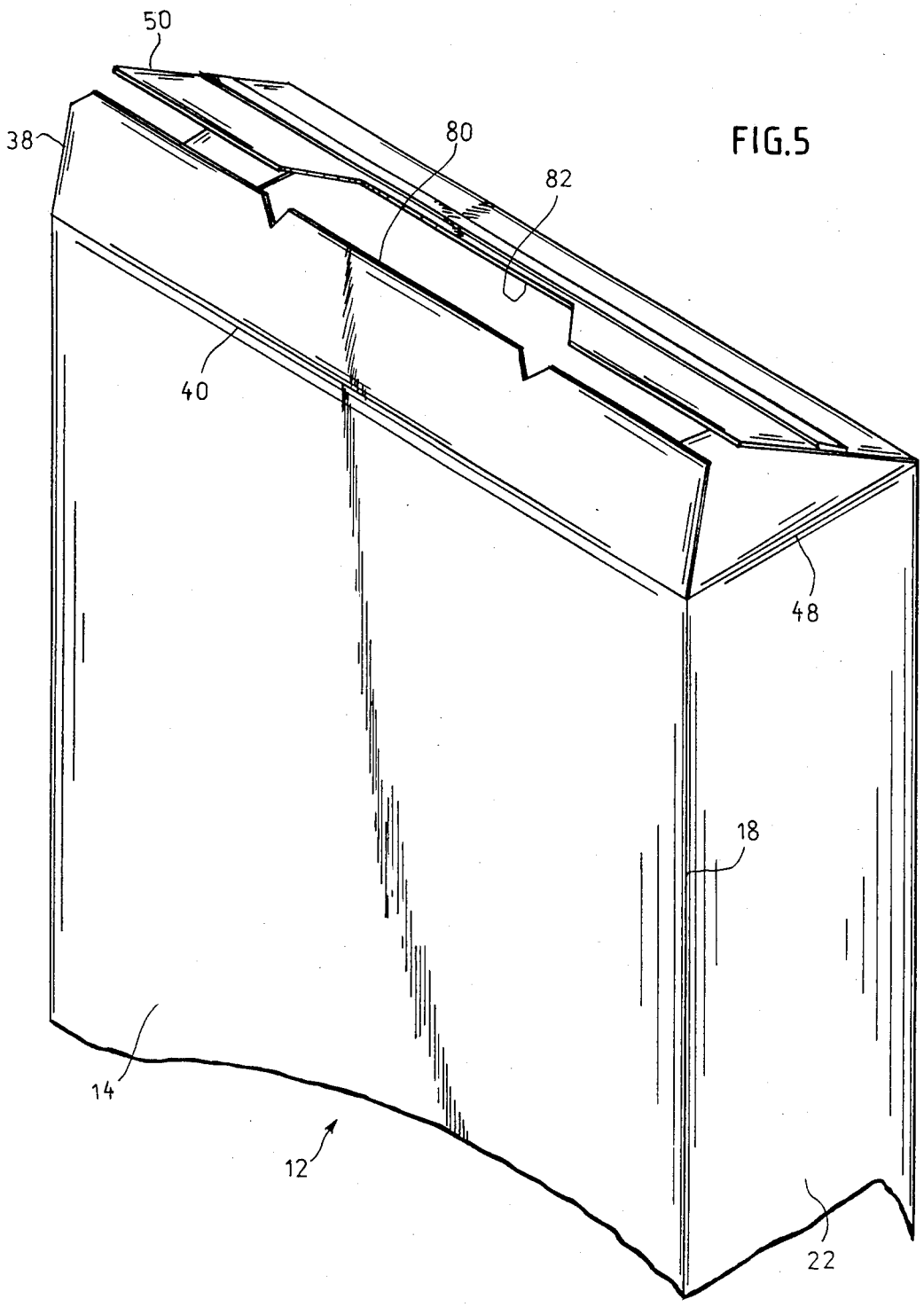
FIG. 5 is a fragmentary perspective view of the carton of FIG. 2 after it has been opened.

FIG. 2 shows carton 12 after it has been erected, filled with product and sealed. Since front panel top end flap 38 forms a tight adhesive connection with back panel top end flap 50, it is not possible to separate the two flaps from one another at their adhesive connection without to some degree destroying the flaps. Thus, it would not be possible for anyone to tamper with the carton by separating these flaps and re-gluing them without such tampering being evident to a potential consumer. The filled and sealed carton, as seen in FIG. 2, may be opened, such as by the consumer, by grasping tab 77 of tear strip 76 and tearing tear strip 76 from front panel top end flap 38, as seen in FIG. 4, to thereby disconnect flap 38 from flap 50. Then, the disconnected front and back panel top end flaps 38 and 50 are lifted, as clearly seen in FIG. 5, to thereby render the contents of carton 12 accessible to the consumer. In order to reclose the carton after its initial opening, it is merely necessary to engage male tab element 80 of front panel top end flap 38 with female tab element 82 of back panel top end flap 50 so as to releasably lock the two flaps together.

While only a single embodiment of the present invention has been shown and described, it will be obvious that many changes and modifications may be made thereunto without departing from the spirit and scope of the invention.

What is claimed is:

1. A carton formed of sheet material comprising:

a front wall panel;

a back wall panel;

a pair of opposed side wall panels interconnecting said front and back wall panels;

a bottom wall formed of bottom wall flaps hingedly connected to said front, back and side panels, folded over and adhesively connected together;

a top wall formed of top wall flaps hingedly connected to said front, back and side panels, one of said front and back panel top flaps overlapping the other one of said front and back panel top flaps, said overlapping top flap forming a tight adhesive connection along an outer edge with said underlying top flap and including a tear strip the removal of which disconnects said overlapping top flap from said underlying top flap; and a hot melt coated string which is heat activated and applied under pressure onto the inside of said overlapping top end flap to form a narrow tape adhered along the path of the tear strip, said narrow tape tearing through the sheet material of said overlapping flap upon removal of the tear strip.

2. The carton as defined in claim 1, which further comprises a tab formed at one end of said tear strip.

3. The carton as defined in claim 1, which further comprises reclosure means in said top wall for releasably reconnecting said overlapping top flap with said underlying top flap subsequent to the removal of said tear strip.

4. The carton as defined in claim 1, which further comprises male and female tab engaging elements formed in said front and back panel top flaps which are adapted to engage each other for reclosure of the top wall of the carton subsequent to disconnection of said overlapping top flap from said underlying top flap by removal of said tear strip.

5. The carton as defined in claim 1, wherein said tear strip is disposed in said overlapping top flap between the adhesive connection of said flap to the underlying top flap and the hinged connection of said overlapping top flap to its respective wall panel.

6. The carton as defined in claim 1, wherein the hot melt of the hot melt coated string is applied to the string as the string is applied to the tear strip and the hot melt coated string is applied under pressure to the inside of said overlapping top end flap.

7. The carton as defined in claim 1, which further includes cut score lines on the outside of said overlapping top flap delimiting said tear strip.

8. The carton as defined in claim 1, wherein the material from which said carton is formed is paperboard.

9. An integral, suitably cut and scored blank of sheet material adapted to be erected into a carton, comprising:

a first major panel;

a pair of opposed side wall panels hingedly connected to the sides of said first major panel;

a second major panel hingedly connected to a free side of one of said pair of side panels;

an adhesive panel hingedly connected to a free side of said second major panel;

a first major panel bottom wall flap hingedly connected to said first major panel;

a pair of side wall panel bottom wall flaps each hingedly connected to one of said pair of side wall panels;

a second major panel bottom wall flap hingedly connected to said second major panel;

a first major panel top wall flap hingedly connected to said first major panel;

a pair of side wall panel top wall flaps each hingedly connected to one of said pair of side wall panels;

a second major panel top wall flap hingedly connected to said second major panel, said first and second major panel top wall flaps being adapted to overlap one another when said carton is erected;

a tear strip in the overlapping flap of said first and second major panel top wall flaps; and a hot melt coated string which is heat activated and applied under pressure to form a narrow tape adhered onto the surface of said overlapping top end flap which ultimately forms the inside surface of the carton along the path of the tear strip, said narrow tape tearing through the sheet material of said overlapping flap upon removal of the tear strip.

10. The carton blank as defined in claim 9, which further comprises a tab formed at one end of said tear strip.

11. The carton blank as defined in claim 9, which further comprises male and female tab engaging elements formed in said first and second major panel top wall flaps.

12. The carton blank as defined in claim 9, wherein said tear strip is disposed inwardly from an outer edge of said overlapping flap between said outer edge and the hinged connection of said flap to its respective major panel.

13. The carton blank as defined in claim 9, wherein the narrow tape which forms said tear strip is formed from string coated with an adhesive at the point of application of the narrow tape.

14. The carton blank as defined in claim 9, which further includes cut score lines on the surface of said overlapping flap delimiting said tear strip, said surface being an outside surface of the erected carton.

15. The carton blank as defined in claim 9, wherein the material from which said blank is formed is paperboard.

* * * * *